US006153876A

United States Patent [19]

Fujita et al.

[11] Patent Number: 6,153,876

[45] Date of Patent: Nov. 28, 2000

[54] OPTICAL SENSOR WITH CONCAVE MIRROR

[75] Inventors: Akihiro Fujita, Kitakatsuragi-gun; Mitsuo Kobachi, Ayama-gun, both of Japan

[73] Assignee: Sharp Kabushiki Kaisha, Osaka, Japan

[21] Appl. No.: 08/956,357

[22] Filed: Oct. 23, 1997

[30] Foreign Application Priority Data

Oct. 24, 1996 [JP] Japan ..... 8-282768

[51] Int. Cl.[7] ..... H01J 3/14

[52] U.S. Cl. ..... 250/216; 250/239; 250/231.18; 257/82

[58] Field of Search ..... 250/216, 239, 250/214.1, 234–236, 231.13–231.18, 221; 257/80–84, 431–436; 356/152.2; 345/161

[56] References Cited

U.S. PATENT DOCUMENTS

| | | | |
|---|---|---|---|
| 3,886,361 | 5/1975 | Wester . | |
| 4,459,022 | 7/1984 | Morey | 356/152 |
| 4,533,827 | 8/1985 | Fincher . | |
| 4,935,728 | 6/1990 | Kley | 340/709 |
| 5,371,374 | 12/1994 | Fritzson | 356/429 |
| 5,659,969 | 8/1997 | Butler et al. | 33/561 |
| 5,665,983 | 9/1997 | Nagano | 257/82 |

FOREIGN PATENT DOCUMENTS

| | | |
|---|---|---|
| 59-4407 | 1/1984 | Japan . |
| 60-93247 | 6/1985 | Japan . |
| 7-210306 | 8/1995 | Japan . |

*Primary Examiner*—Que T. Le
*Attorney, Agent, or Firm*—Nixon and Vanderhye P.C.

[57] ABSTRACT

An optical sensor includes a sensor section provided in a secured manner and including a light emitting element and a light receiving element located opposed to the light emitting element; and a reflective body connected to an operation section and movable with respect to the sensor section. The reflective body is a concave mirror for guiding light from the light emitting element to the light receiving element.

13 Claims, 16 Drawing Sheets

Angle of stick:−45 degrees

OPTICAL SENSOR WITH CONCAVE MIRROR

BACKGROUND OF THE INVENTION

1. Field of the Invention

The present invention relates to an optical sensor preferably used in an input device for moving a pointer or the like on a screen of a personal computer or the like or in an input device for an electronic game machine, and more specifically relates to a one-dimensional or a two-dimensional optical sensor for sensing the movement of a control arm section maneuvered by the operator in a wide range of angles with a high resolution.

2. Description of the Related Art

Conventional pointing devices as an input device for moving the pointer on the screen of a computer or the like include a joystick and a button type pointing device.

FIG. 17 is an isometric view of a conventional joystick 8. When a stick or control arm 1 moves in an X direction, the movement of the stick 1 is conveyed via a guide 2 and a shaft 3 to a rotary encoder 4 for detecting a rotation direction and a rotation distance. Based on a detection signal from the rotary encoder 4, the rotation direction and the rotation distance of the stick 1 in the X direction are detected. Also, a movement of the stick 1 in a Y direction is conveyed to a rotary encoder 7 via a guide 5 and a shaft 6. Based on a detection signal from the rotary encoder 7, the rotation direction and the rotation distance of the stick 1 in the Y direction are detected.

With reference to FIGS. 18A and 18B, the principle by which the rotary encoders 4 and 7 detect the rotation direction and the rotation distance will be described. When a shaft 11 rotates in association with the movement of the stick 1, a rotatable plate or disk 12 connected to the shaft 11 rotates. The rotatable plate 12 has a plurality of slits 13 formed radially. The rotatable plate 12 is interposed between two light emitting elements 9 and two light receiving elements 10. Light emitted from the light emitting elements 9 is transmitted through the slits 13 as a pulse signal which is converted into an electric signal by the light receiving elements 10. As a result, the rotation direction and the rotation distance of the stick 1 in the X and Y directions in accordance with the counts of the pulse signal are electrically detected.

On the screen of the computer which includes the joystick 8 as a part of the input device, the pointer moves in accordance with the electric signal which indicates the rotation direction and the rotation distance of the stick 1 in the X and Y directions.

FIG. 19 shows a conventional button type pointing device 20 usable as an input device. The button type pointing device 20 includes a button-shape tiltable operation section 18, a holder 20*a* provided below the operation section 18, a base plate 16 supporting the holder 20*a* from a bottom surface of the holder 20*a*, and a sensor section 15 attached to a bottom surface of the base plate 16. The holder 20*a* includes an elastic section 17 provided below the operation section 18 and having a depression for attachment of a reflective body in a central part of a bottom surface thereof, and a reflective body 19 provided in the depression. The elastic section 17 and the reflective body 19 are formed integrally.

In the button type pointing device 20 having the above-described structure, when the operation section 18 is inclined, the elastic section 17 is elastically deformed. The reflective body 19 formed on the elastic section 17 is also inclined in the same direction, and the inclination of the reflective body 19 is detected by the sensor section 15. A detection signal output by the sensor section 15 is converted into an electric signal and output. In accordance with the electric signal, the pointer on the screen moves.

FIG. 20 is an enlarged view of the sensor section 15. The sensor section 15 is an optical sensor including a light emitting element 15*a* and light receiving elements 15*b* provided above the light emitting element 15*a*. A lens 22 is provided above the light receiving elements 15*b*. In FIG. 20, reference numeral 23 denotes a secondary mold.

The conventional joystick 8 involves the following drawbacks when being used in an input device.

(1) The rotary encoders 4 and 7 each include the rotatable shaft 11. A space for accommodating the rotation of the shaft 11 needs to be provided, and thus it is difficult to completely seal the rotary encoders 4 and 7. This provides easy access for dust, which may undesirably clog the slits 13. Accordingly, malfunctions can occur relatively easily and thus the reliability is not sufficient.

(2) Since the number of the slits 13 which can be formed in the rotatable disk 12 is limited, the resolution for sensing is also limited.

(3) Two-dimensional detection of the movement of the stick 1 requires provision of rotary encoders in both the X and Y directions. Such an increase in the number of components hampers the size reduction of the apparatus including the joystick 1, and is also against space-saving.

The conventional button type pointing device 20 has the following drawbacks when being used in an input device.

(1) Due to the use of the sensor section 15 which does not require a rotatable shaft, the button type pointing device 20 can be sealed and thus is substantially free of malfunction caused by dust, like in the case of the joystick 1. However, the button type pointing device 20 has a relatively narrow range of detection angles of ±10 degrees due to the structure thereof and cannot perform wide-range sensing. Since the reflective body 19 is a plane mirror, when the angle of inclination of the reflective body 19 in association with the operation section 18 is excessively large, the light reflected by the reflective body 19 is not effectively guided to the light receiving elements 15*b*.

In the case of the button type pointing device 20 which is used in an input device of a game machine, the operation section 18 needs to be movable over a wide range of angles so as to increase the fun of playing, especially for young children.

In the conventional button type pointing device 20 which cannot provide a satisfactory level of wide-range sensing, the operability of the operation section 18 is also restricted. Improvement on this point is required in order to provide a more satisfactory input device for a game machine.

(2) The sensor section 15 requires a lens 22 such as an objective lens for collecting light and also requires the secondary mold 23. Such additional elements unavoidably increase the thickness of the sensor section 15 as indicated by t1 in FIG. 20, which is an obstacle in reducing the size of the sensor section 15.

Accordingly, it would be desirable to have a pointing device as an input device that moves through a wide range of motion and has increased sensitivity and a more compact size.

SUMMARY OF THE INVENTION

According to one aspect of the invention, an optical sensor according to the present invention includes a sensor section provided in a secured manner and including a light emitting element and a light receiving element located opposed to the light emitting element; and a reflective body connected to an operation section and movable with respect to the sensor section. The reflective body is a concave mirror for guiding light from the light emitting element to the light receiving element.

According to another aspect of the invention, an optical sensor includes a sensor section provided in a secured manner and including a light emitting element and a plurality of light receiving elements located two-dimensionally with respect to the light emitting element; and a reflective body connected to an operation section and movable two-dimensionally with respect to the sensor section. The reflective body is a concave mirror for guiding light from the light emitting element to the plurality of light receiving elements.

In one embodiment of the invention, the concave mirror is pivotally supported along a circumferential surface thereof by a support.

In one embodiment of the invention, the center of curvature of the concave mirror is shifted with respect to the center of pivoting of the concave mirror.

In one embodiment of the invention, the concave mirror has an outer slidable surface having the center of curvature at the center of pivoting of the concave mirror, and the support has an inner guide surface.

In one embodiment of the invention, the support has a stopper section, and the concave mirror has a stopper member contactable with the stopper section of the support.

In one embodiment of the invention, the concave mirror is connected to the operation section via a supporting column standing on the concave mirror, the sensor section is supported by an arm in a secured manner, and the arm is provided at such a position that avoids interference between the supporting column which moves integrally with the operation section and the concave mirror.

In one embodiment of the invention, a section including the sensor section, the concave mirror, the support, the arm, and the supporting column is sealed by a sealing device.

According to the optical sensor of the present invention, a concave mirror is used as a reflective body. Since the concave mirror has a light collecting function, a lens such as an objective lens is not required. The thickness of the sensor section can be reduced and be closer to the concave mirror by the thickness of the lens. Thus, the total thickness of the optical sensor can be reduced. This is advantageous in reducing the size and production cost.

The concave mirror, unlike a plane mirror, can effectively guide the reflected light to a light receiving element. Such a feature of the concave mirror realizes a wide-range sensing with a high resolution. The operation section can move in a wide range of angles. The optical sensor having such a structure is preferably usable in an input device of a game machine and other devices for which the wide-ranging movement of the operation section is desired.

In the case where the optical sensor according to the present invention is used for a pointing device of a computer, the moving distance through which the pointer is moved can be reduced compared to the moving distance of the operation section. Therefore, the pointer can be moved more precisely.

The optical sensor, which can detect light in a non-contact fashion, has improved durability. Unlike the rotary encoder, the sensor section does not require a rotatable shaft and thus can be sealed. Therefore, malfunctions caused by dust can be avoided. Accordingly, high precision detection is realized for a long period of time, which improves the reliability.

In the structure where the light receiving elements are arranged two-dimensionally with respect to the light emitting element, the angle of two-dimensional inclination of the operation section, namely, the two-dimensional operation amount of light, can be detected by one sensor section. Unlike the case of using rotary encoders, one sensor is sufficient. This contributes to further size reductions.

In the structure where the concave mirror is supported along the circumferential surface thereof, the concave mirror and the operation section associated with the concave mirror can be moved in an arbitrary direction relatively easily.

In the structure where the center of curvature of the concave mirror is shifted with respect to the center of pivoting, the range of sensing angles can be adjusted relatively easily as can be appreciated from the example presented below. Such an optical sensor is widely applicable to various types of input devices in accordance with the required range of detection angles.

In the case where the concave mirror has an outer slidable surface having the center of curvature at the center of pivoting of the concave mirror and the support has an inner guide surface, the operation section can be moved smoothly so as to realize improved operability.

In the structure where the support has a stopper section and the concave mirror has a stopper member contactable with the stopper section of the support, the concave mirror and the operation section can be positioned at a prescribed angle of inclination with certainty. As a result, the concave mirror and the operation section can not be damaged accidentally.

The structure in which the concave mirror is connected to the operation section via a supporting column standing on the concave mirror, the sensor section is supported by an arm in a secured manner, and the arm is provided at such a position that avoids interfering with the supporting column which moves integrally with the operation section and the concave mirror is advantageous in increasing the angle of inclination of the operation section.

In the structure where a section including the sensor section, the concave mirror, the support, the arm, and the supporting column is sealed by a sealing device, external disturbance light is prevented from being detected by the sensor section. Thus, the detection accuracy is enhanced.

Thus, the invention described herein makes possible the advantages of (1) providing an optical sensor having a substantially complete sealed structure and improved reliability, (2) providing an optical sensor for sensing a dynamic movement of the operation section over a wide range of angles with a high resolution, and (3) providing a compact and thin optical sensor which provides space savings and improved operability when being used in an input device of a computer or the like.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
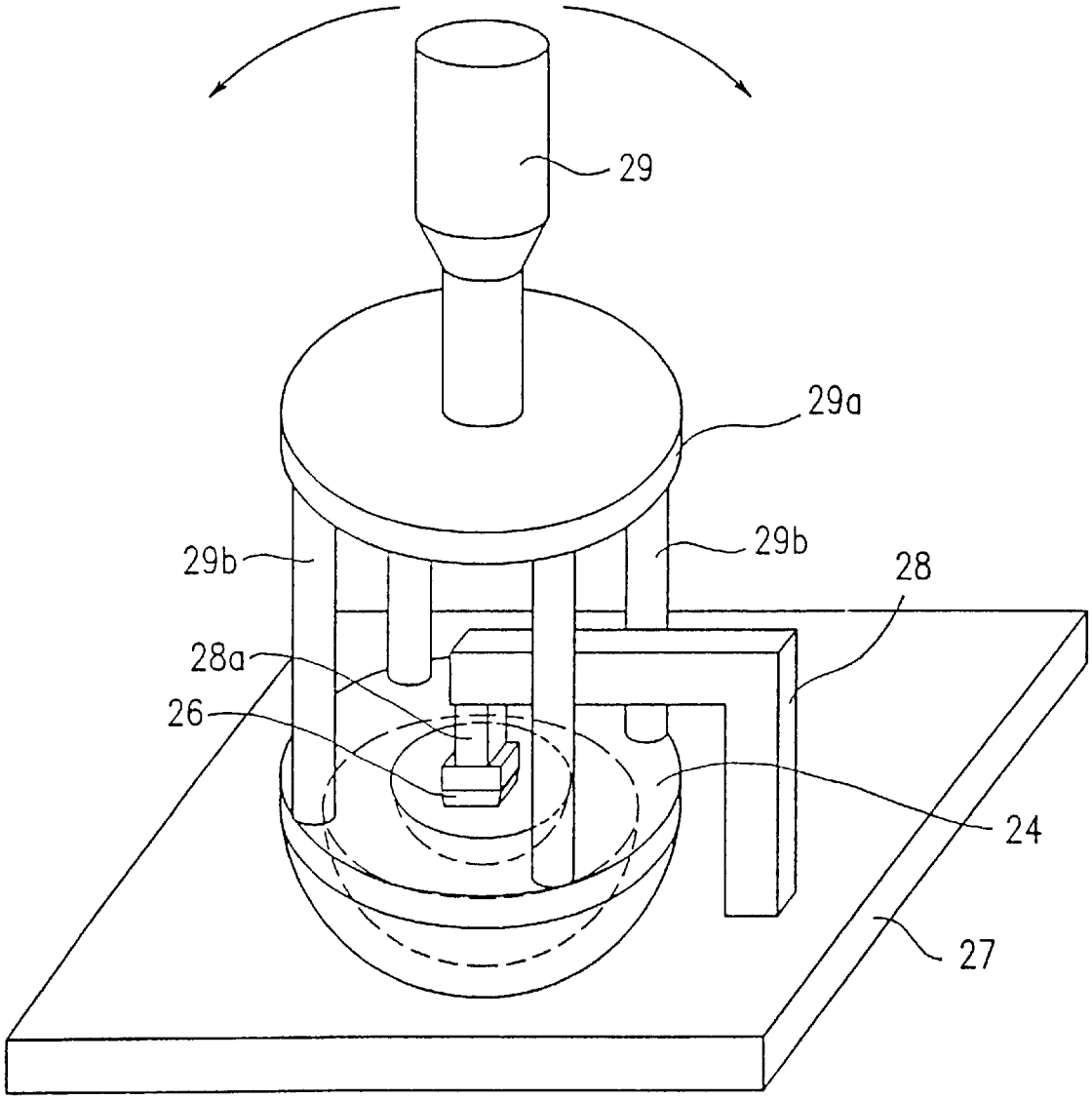
FIG. 1 is an isometric view conceptually showing a basic structure of an optical sensor according to the present invention.

With reference to FIG. 1, a basic structure of an optical sensor in an example according to the present invention will be described. FIG. 1 shows the basic structure of the optical sensor only conceptually, and detailed shapes and structures of elements of the optical sensor will become apparent from other figures described below.

As shown in FIG. 1, the optical sensor includes a rod-like stick 29 extended in a vertical direction, and a disc-shaped connection plate 29*a*. A bottom end of the stick 29 is connected to a central part of the connection plate 29*a*. The optical sensor further includes a concave mirror 24 as a reflective body, four supporting columns 29*b* for connecting the connection plate 29*a* and the concave mirror 24, a generally L-shaped arm 28 standing on a base plate 27, and a sensor section 26 attached to a tip of an extension arm 28*a*.

Figure 2B:
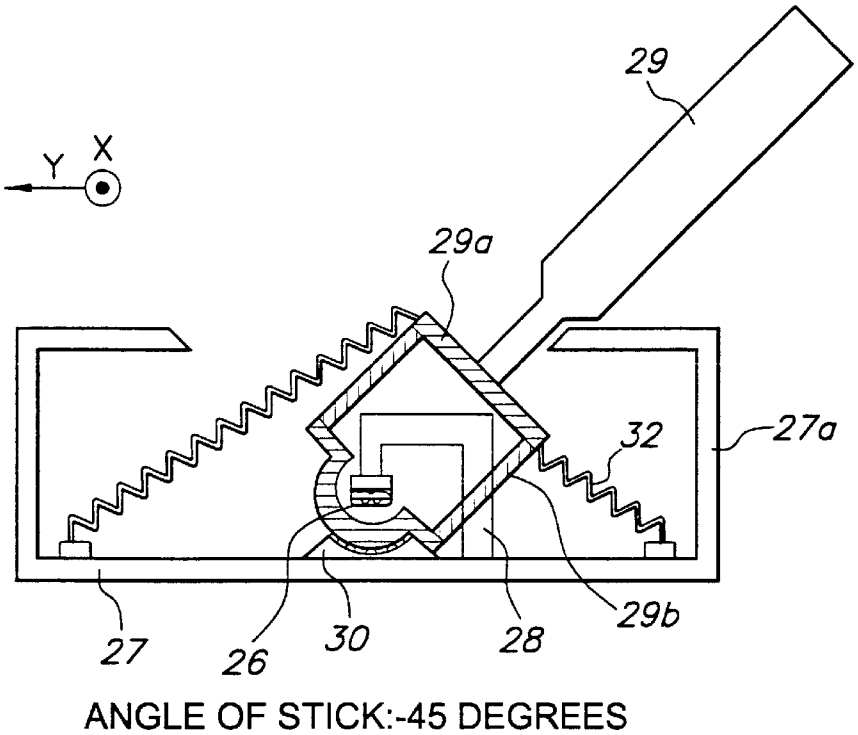
FIG. 2B is a cross-sectional view of an inversion-type optical sensor according to the present invention when the stick is inclined at −45 degrees.
Figure 2A:
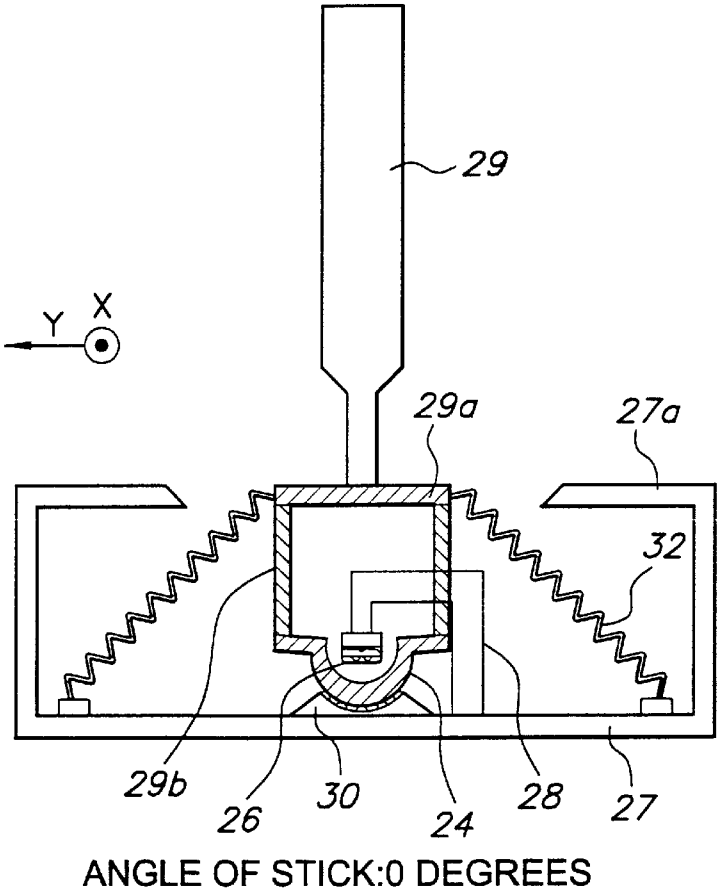
FIG. 2A is a cross-sectional view of an inversion-type optical sensor according to the present invention when a stick is inclined at 0 degrees.

FIGS. 2A and 2B show the basic structure of the optical sensor together with the other elements. A side wall 27*a* is disposed around the base plate 27, and the base plate 27 and the side wall 27*a* form a casing. The casing has an opening at a top central part thereof for allowing the stick 29 and other elements attached thereto to move in X and Y directions.

As shown in FIGS. 2A and 2B, bellows 32 are connected to the connection plate 29*a* at a top side thereof and also are connected to the base plate 27 at a bottom side thereof. The part of the optical sensor below the connection plate 29*a* is sealed by the bellows 32. External disturbance light is thus prevented from being sensed by the sensor section 26 and so does not interfere with the detection accuracy of the optical sensor.

The concave mirror 24 is pivotally supported along a circumferential surface thereof by a guide 30 secured to the base plate 27. When the stick 29 is inclined in the X and Y directions at, for example, 45 degrees, the concave mirror 24 is also inclined smoothly in the X and Y directions at 45 degrees.

The stick 29 is supported by the bellows 32 so as not to rotate through 360 degrees about the vertical axis. However, the deformability of the bellows 32 allows the stick 29 to incline in the X and Y direction at, for example, ±45 degrees.

Figure 3:
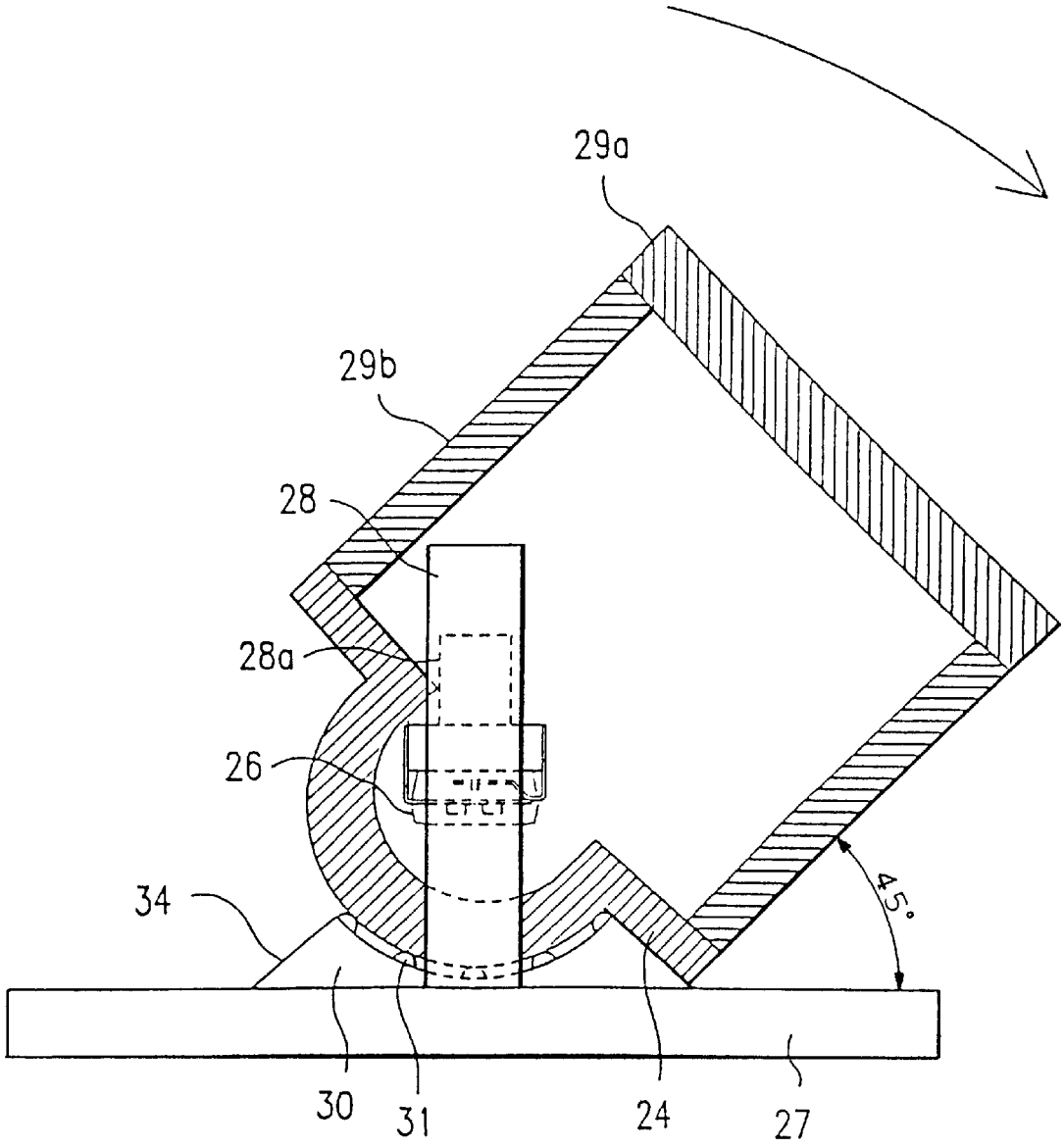
FIG. 3 is a cross-sectional view of a lower part of the inversion-type optical sensor according to the present invention showing the positional relationship between an arm and a concave mirror when the stick is inclined at −45 degrees.
Figure 4:
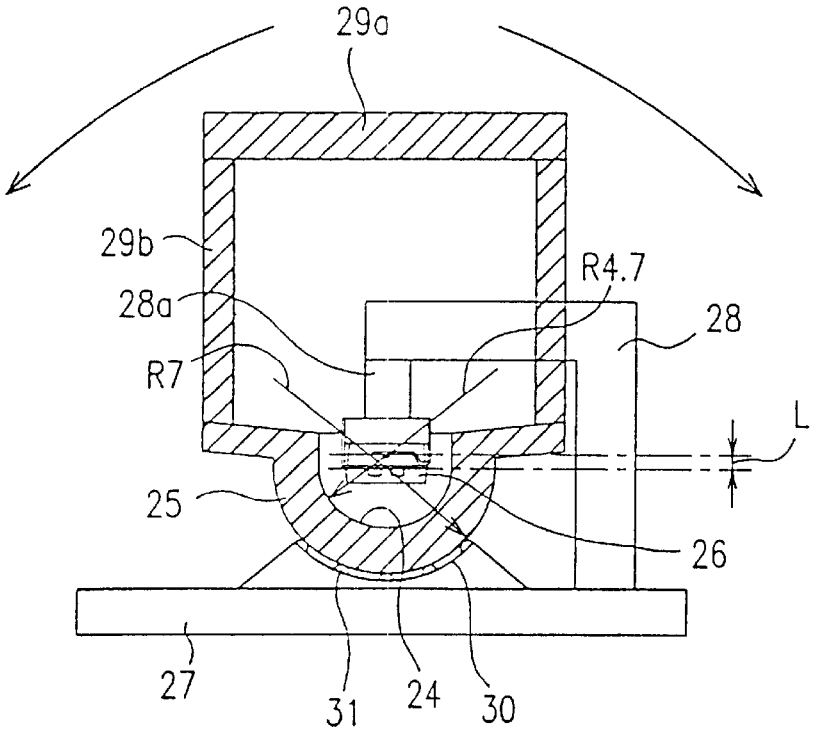
FIG. 4 is a cross-sectional view of a lower part of the inversion-type optical sensor according to the present invention.

The arm 28 is, as shown in FIG. 1, appropriately positioned among the plurality of supporting columns 29*b* so as not to destroy the concave mirror 24 by contact therewith even when the stick 29 is inclined at −45 degrees as shown in FIG. 3.

In order to avoid contact between the arm 28 and the concave mirror 24 as much as possible when the stick 29 is inclined at −45 degrees as shown in FIG. 3, the extension arm 28*a* connected to the arm 28 which may otherwise contact the concave mirror 24 is thinner than the rest of the arm 28.

With reference to FIGS. 4, 5, 6A and 6B, the concave mirror 24, the guide 30 and the sensor section 26 will be described in detail.

The concave mirror 24 has a hollow hemispheric shape, and a circular collar-like connection part 33 (FIG. 5) extends from an outer edge of the concave mirror 24. On the connection part 33, bottom ends of the four supporting columns 29*b* are connected. An outer, circumferential surface 25 of the concave mirror 24 is pivotally and slidably supported by the guide 30 having a guide surface 30*a*. The radius of curvature of the guide surface 30*a* is substantially equal to that of the outer surface 25 of the concave mirror 24.

On the guide surface 30*a*, hemispheric projections 31 are provided for reducing the contact resistance (frictional resistance) between the guide surface 30*a* and the outer surface 25 of the concave mirror 24. Accordingly, the concave mirror 24 is pivotally supported along the circumferential surface thereof by the guide 30 in the state of point contact. Since the frictional resistance is smaller in the state of point contact than in the state of plane contact, the stick 29 connected to the concave mirror 24 can move more smoothly.

Figure 6B:
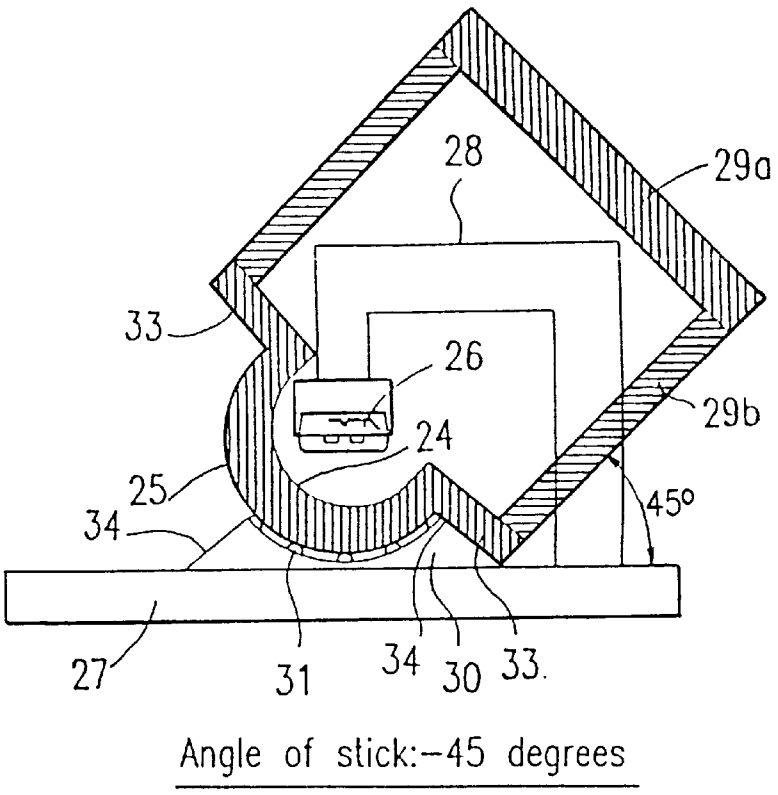
FIG. 6B is a cross-sectional view of the inversion-type optical sensor according to the present invention when the concave mirror is inclined at −45 degrees.
Figure 6A:
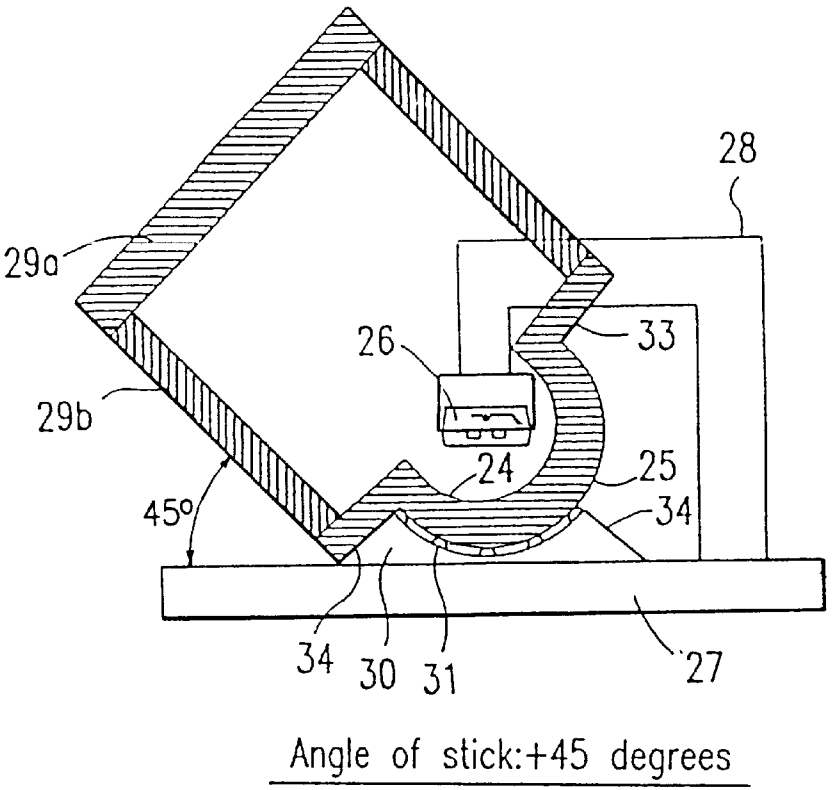
FIG. 6A is a cross-sectional view of the inversion-type optical sensor according to the present invention when the concave mirror is inclined at +45 degrees.

The guide 30 has an inclining stopper surface 34 around the guide surface 30*a*. When the concave mirror 24 is inclined in association with the stick 29 at +45 degrees as shown in FIG. 6A or −45 degrees as shown in FIG. 6B, the connection part 33 contacts the inclining stopper surface 34 so as to avoid further inclination of the concave mirror 24. In other words, the connection part 33 also acts as a stopper. Due to such a structure, the concave mirror 24 is protected with certainty from being destroyed by an excessive load.

Figure 5:
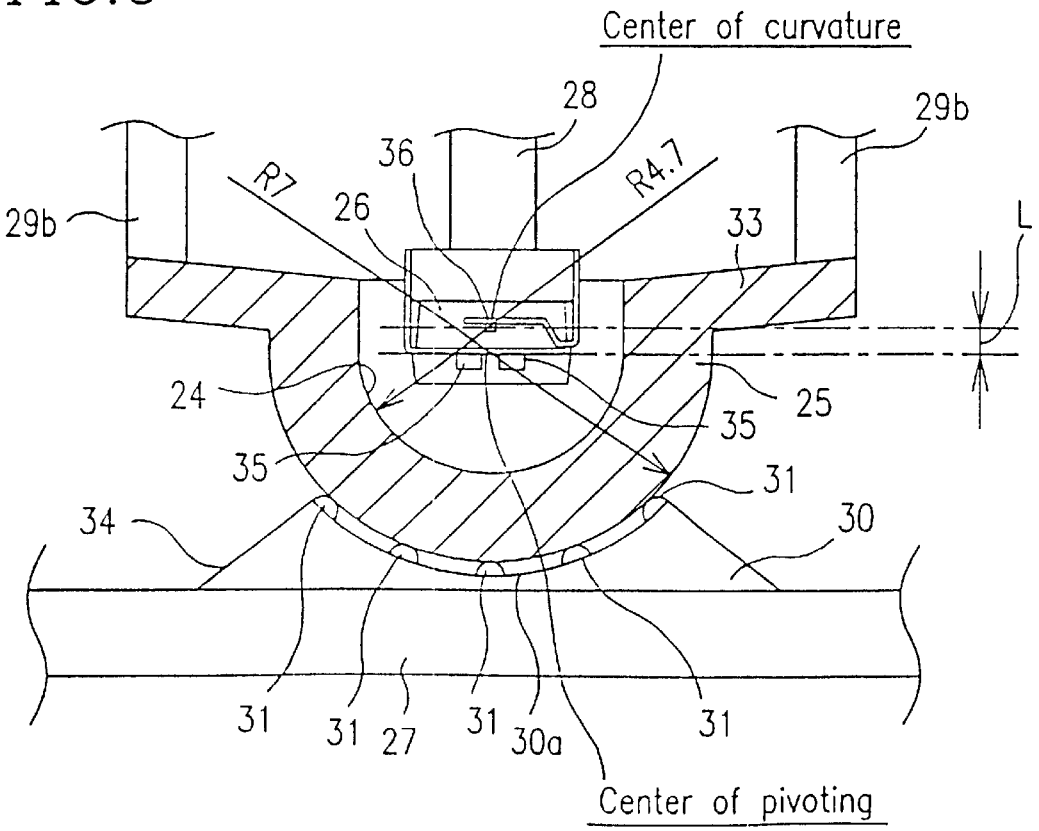
FIG. 5 is a partial enlarged view of the lower part of the optical sensor shown in FIG. 4.

Next, the sensor section 26 will be described. As best shown in FIG. 5, the sensor section 26 is provided at a bottom end of the extension arm 28*a* of the arm 28, and includes a light emitting diode 36 and a plurality of photodiodes 35 disposed below the light emitting diode 36. A plurality of photodiodes 35 are provided both in the X and Y directions.

Light emitted downward from the light emitting diode 36 is reflected by the concave mirror 24, and the reflected light is detected by the photodiodes 35. Since the concave mirror 24 is inclined in association with the stick 29, the amount of light detected by the four photodiodes 35 changes in accordance with the angle of inclination of the concave mirror 24. By detecting the change, the angle of inclination of the concave mirror 24 and also of the stick 29 is detected. The details will be described later.

In the above paragraphs, an "inversion-type" optical sensor in which the concave mirror 24 is provided below the sensor section 26 is described. The present invention is also applicable to a "normal-type" optical sensor in which the concave mirror 24 is provided above the sensor section 26.

Figure 7:
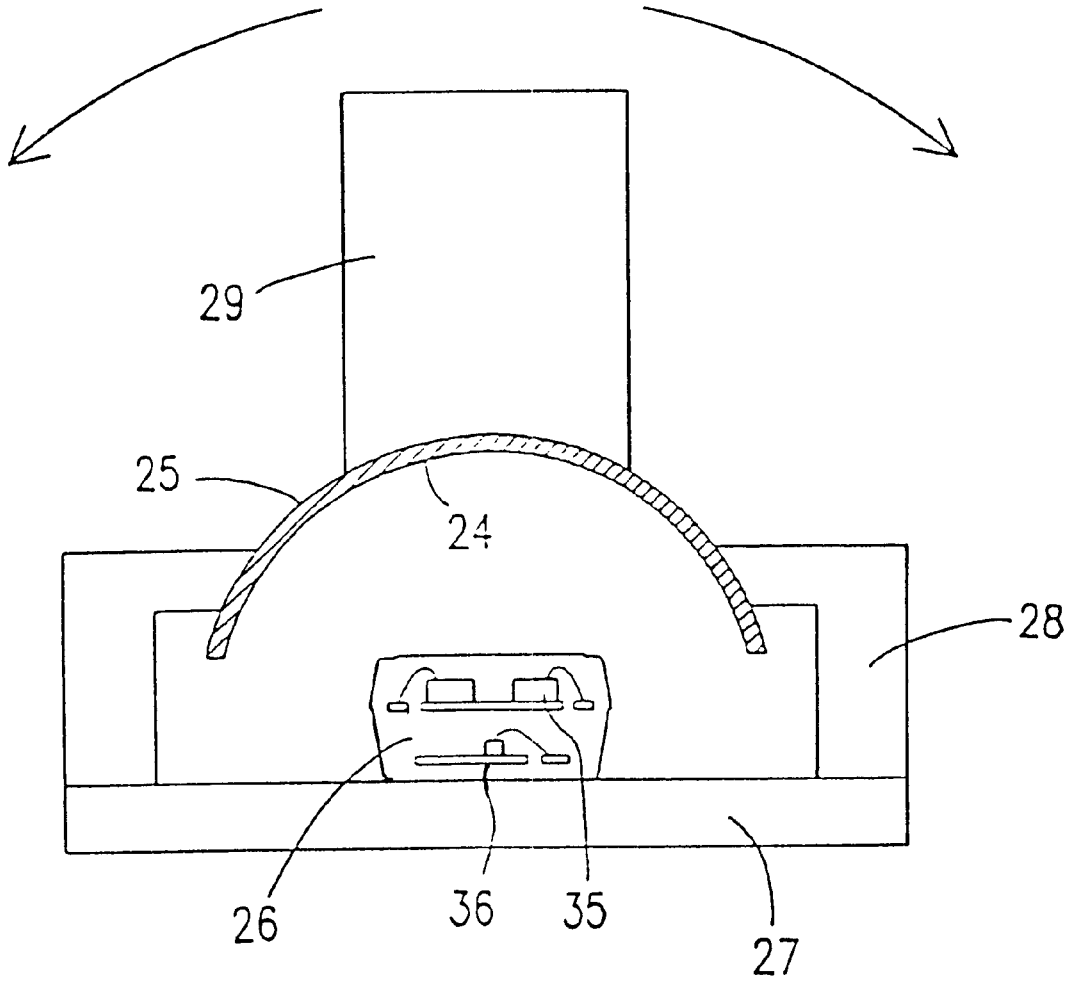
FIG. 7 is a cross-sectional view of a normal-type optical sensor according to the present invention.

FIG. 7 shows such a normal-type optical sensor. Identical elements previously discussed with respect to FIGS. 1 through 6B will bear identical reference numerals therewith and the descriptions thereof will be omitted. As shown in FIG. 7, a pair of arms 28 stands on the base plate 27 with an appropriate distance therebetween. A concave mirror 24 is supported between the arms 28 with the inwardly curved side being directed downward. The stick 29 is connected to the outer surface 25 of the concave mirror 24. The concave mirror 24 can be inclined in the X and Y directions in association with the stick 29.

On the base plate 27 located below the concave mirror 24, the sensor section 26 is secured. The sensor section 26 includes a light emitting diode 36 and a plurality of photodiodes 35 provided above the light emitting diode 36. The sensor section 26, which does not require a rotatable shaft, can be sealed substantially completely. Accordingly, the optical sensor is substantially free of malfunctions caused by dust or the like.

With reference to FIGS. 8A through 15, the principle of light detection according to the present invention will be described. As an example, the normal-type optical sensor will be used. The same principle is applied to the inversion-type optical sensor.

Figure 8B:
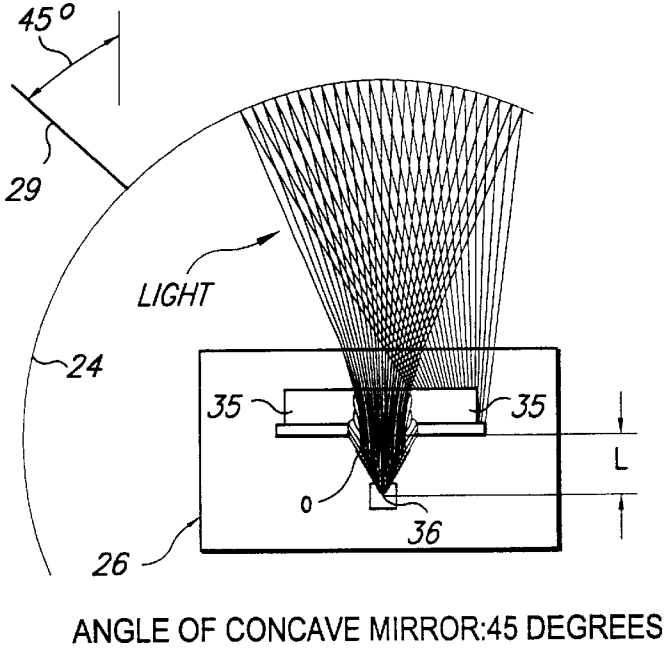
FIG. 8B is a view showing light propagation of the normal-type optical sensor according to the present invention when the concave mirror is inclined at +45 degrees.
Figure 8A:
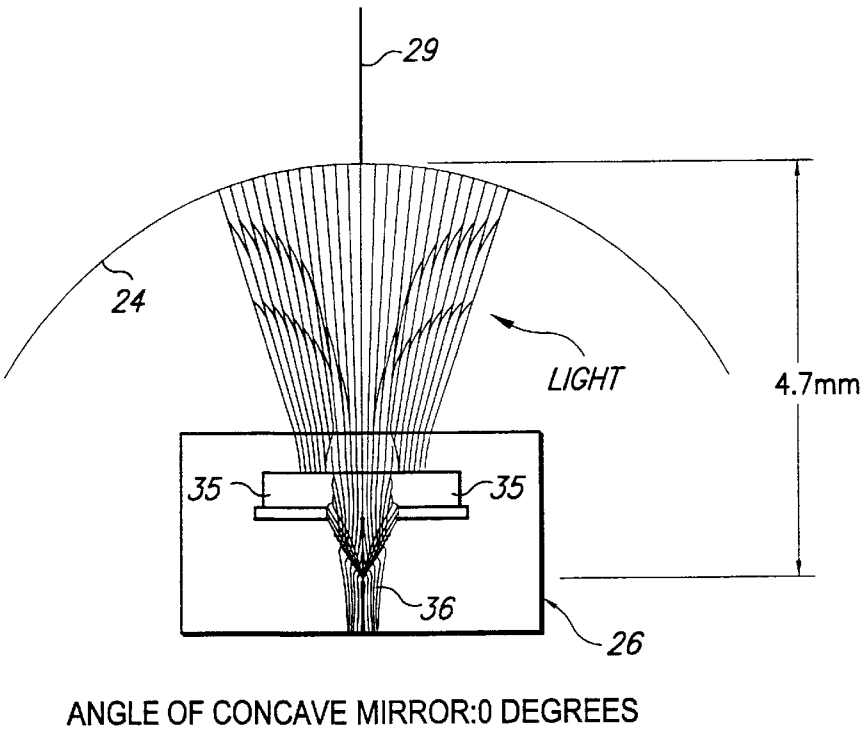
FIG. 8A is a view showing light propagation of the normal-type optical sensor according to the present invention when the concave mirror is inclined at 0 degrees.

FIGS. 8A and 8B show light propagation in the optical sensor according to the present invention. FIG. 8A shows the light propagation when the stick 29 and the concave mirror 24 are inclined at 0 degrees, and FIG. 8B shows the light propagation when the stick 29 and the concave mirror 24 are inclined at +45 degrees.

As shown in FIG. 8A, when the stick 29 and the concave mirror 24 are inclined at 0 degrees, the light is emitted upward from the light emitting diode 36, and the light reflected downward by the concave mirror 24 is uniformly received by the photodiodes 35.

As shown in FIG. 8B, when the stick 29 and the concave mirror 24 are inclined at +45 degrees, the light reflected by the concave mirror 24 is received only by the right photodiode 35 as seen in FIG. 8B but not by the left photodiode 35.

By obtaining the difference in the amount of light detected by the two photodiodes 35, the angle of inclination of the concave mirror 24 and also of the stick 29 can be detected.

The specifications of an exemplary optical sensor used for the simulation shown in FIGS. 8A and 8B are as follows.

The concave mirror 24 has a radius of curvature R of 4.7 mm, and the center of curvature is the center of the light source (light emitting diode 36). The distance L between the center of pivoting O of the concave mirror 24 and the center of the light source (i.e., the center of curvature) is 0.7 mm. The radius of curvature of the outer surface 25 of the concave mirror 24 is 7 mm. (See FIGS. 4 and 5).

The principle of light detection will be described in more detail below.

Figure 9:
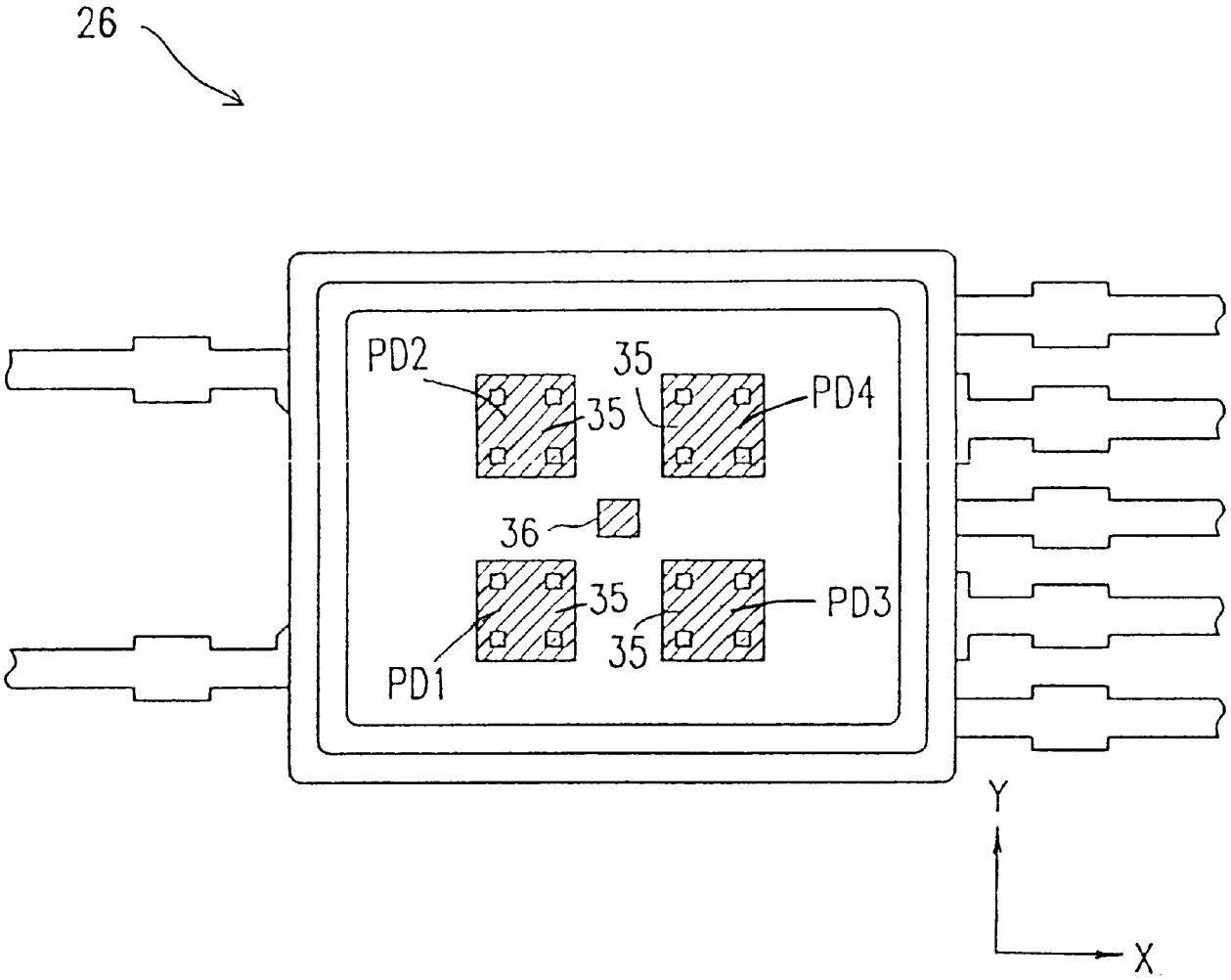
FIG. 9 is a plan view showing a sensor section in the normal-type optical sensor according to the present invention.
Figure 10:
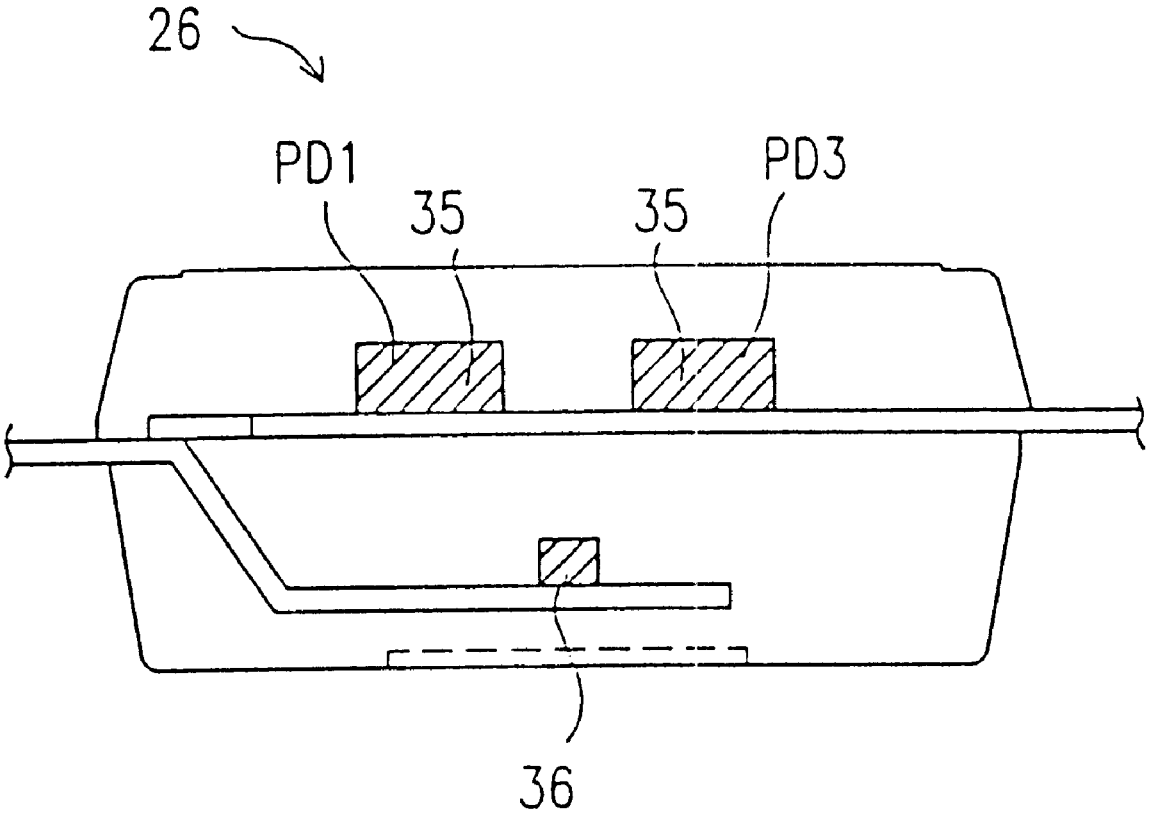
FIG. 10 is a cross-sectional view showing the sensor section in the normal-type optical sensor according to the present invention.

As shown in FIGS. 9 and 10, the sensor section 26 includes four photodiodes 35 (hereinafter, represented as PD1 through PD4) and one light emitting diode 36. In this example, the four photodiodes 35 are provided above the light emitting diode 36. The specific structure is described in Japanese Patent Application No. 8-75008 and will not be described in detail here.

As seen from FIG. 9, the four photodiodes PD1 through PD4 are arranged around the center of the light emitting diode 36 (i.e., the light source) at an interval of 90 degrees. A set of the photodiodes PD1 and PD3 is arranged in the X direction and a set of the photodiode PD2 and PD4 is also arranged in the X direction. A set of the photodiodes PD1 and PD2 is arranged in the Y direction and a set of the photodiode PD3 and PD4 is also arranged in the Y direction.

With the sensor section 26 having the above-described structure, the light emitted by the light emitting diode 36 is reflected by the concave mirror 24, and received and converted into an electric signal by the photodiodes PD1 through PD4. The four photodiodes PD1 through PD4 respectively output electric signals in accordance with the amount of light received.

Figure 11:
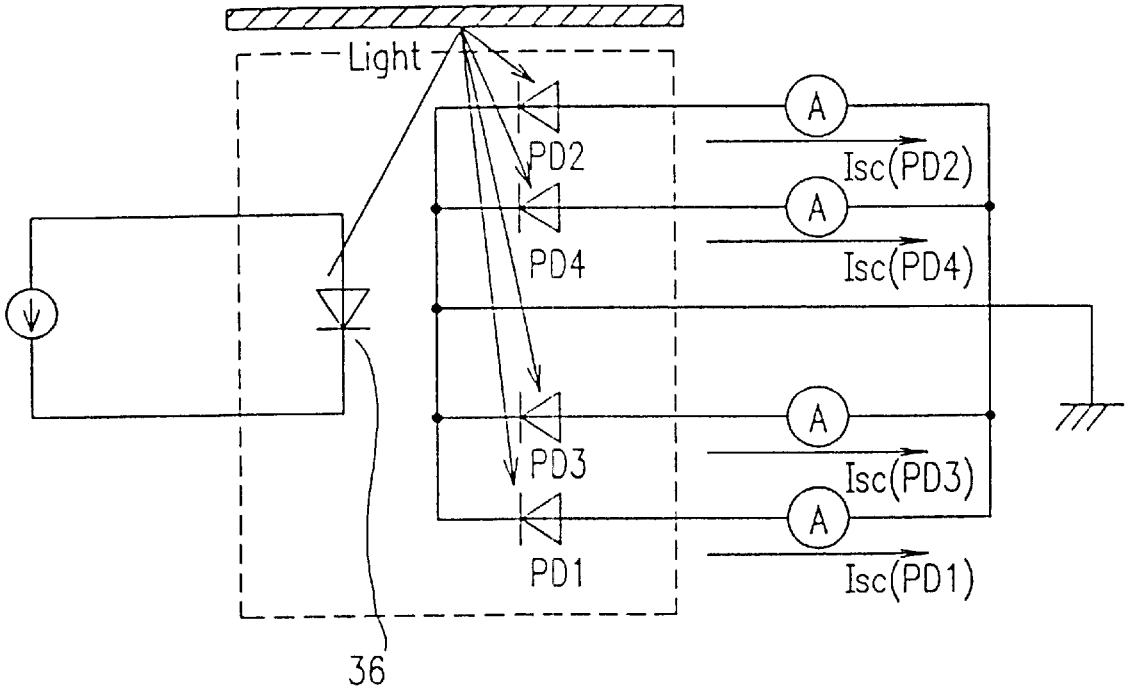
FIG. 11 is a circuit diagram of the sensor section.

FIG. 11 shows a circuit configuration for detecting the light. The outputs from the photodiodes PD1 through PD4 are processed by addition and subtraction by amplifiers A.

Figure 12A:
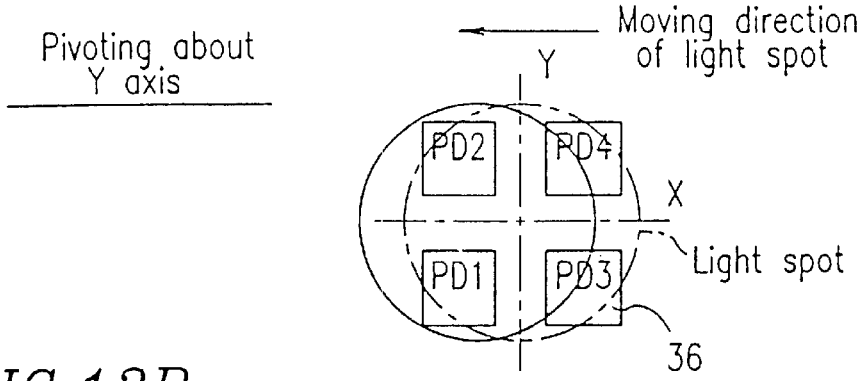
FIG. 12A is a view illustrating the direction in which a light spot moves in the X direction.
Figure 12B:
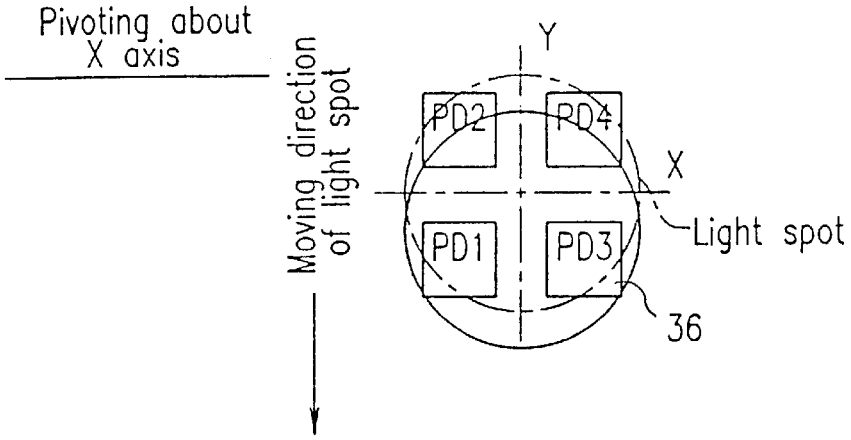
FIG. 12B is a view illustrating the direction in which a light spot moves in the Y direction.

FIGS. 12A and 12B respectively show directions in which a light spot received by the photodiodes PD1 through PD4 moves in the X and Y directions in accordance with the inclination of the concave mirror 24. When the concave mirror 24 performs Y-axis pivoting (pivoting in the X direction about the Y axis), the light spot moves in the X direction as shown in FIG. 12A. When the concave mirror 24 performs X-axis pivoting (pivoting in the Y direction about the X axis), the light spot moves in the Y direction as shown in FIG. 12B.

Figure 13:
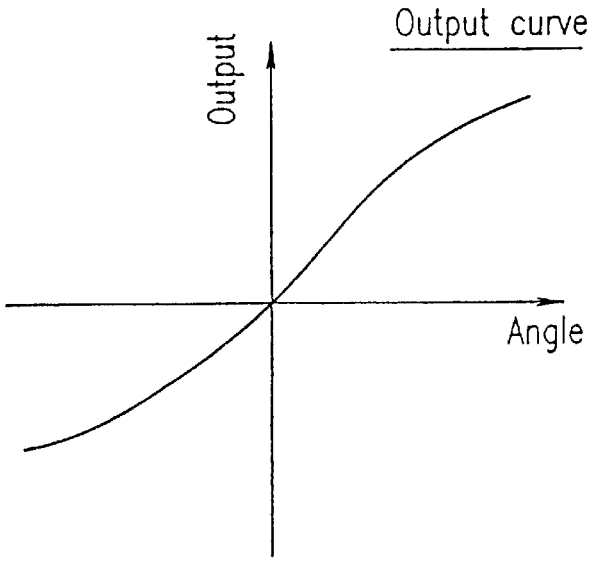
FIG. 13 is a graph qualitatively showing the relationship between the angle of inclination and the detection output.

When the light spot moves as described above, the subtraction output of the photodiodes PD1 through PD4 of the X-axis pivoting, i.e., ((PD2+PD4)−(PD1+PD3)) and the subtraction output of the photodiodes PD1 through PD4 of the Y-axis pivoting, i.e., ((PD1+PD2)−(PD3+PD4)) change as shown in FIG. 13. By obtaining these outputs, the angle of inclination of the concave mirror 24 in the X and Y directions is detected.

Hereinafter, a specific calculation method for detecting the angle will be described.

Step 1

Subtraction output $A_X$ of the X-axis pivoting represented by expression (1) is obtained.

$$A_X=(Isc_{(PD2)}+Isc_{(PD4)})-(Isc_{(PD1)}+Isc_{(PD3)}) \quad \text{expression (1)}$$

Step 2

Subtraction output $A_Y$ of the Y-axis pivoting represented by expression (2) is obtained.

$$A_Y=(Isc_{(PD1)}+Isc_{(PD2)})-(Isc_{(PD3)}+Isc_{(PD4)}) \quad \text{expression (2)}$$

Step 3

Addition output $B_{X,Y}$ of the X-axis pivoting and Y-axis pivoting represented by expression (3) is obtained.

$$B_{X,Y}=Isc_{(PD1)}+Isc_{(PD2)}+Isc_{(PD3)}+Isc_{(PD4)} \quad \text{expression (3)}$$

Step 4

Changes ΔX and ΔY of the subtraction outputs of the X-axis pivoting and Y-axis pivoting respectively represented by expressions (4) and (5) are obtained.

$$\Delta X=A_X/B_X \quad \text{expression (4)}$$

$$\Delta Y=A_Y/B_Y \quad \text{expression (5)}$$

By obtaining the vector of ΔX and ΔY (direction and absolute value of vector sum with respect to the angle of inclination of the concave mirror 24) represented by expression (6), the direction and magnitude (i.e., angle) of inclination of the concave mirror 24 and also of the stick 29 can be obtained.

$$\sqrt{\{(A_X/B_X)^2+(A_Y+/B_Y)^2\}} \quad \text{expression (6)}$$

Figure 14:
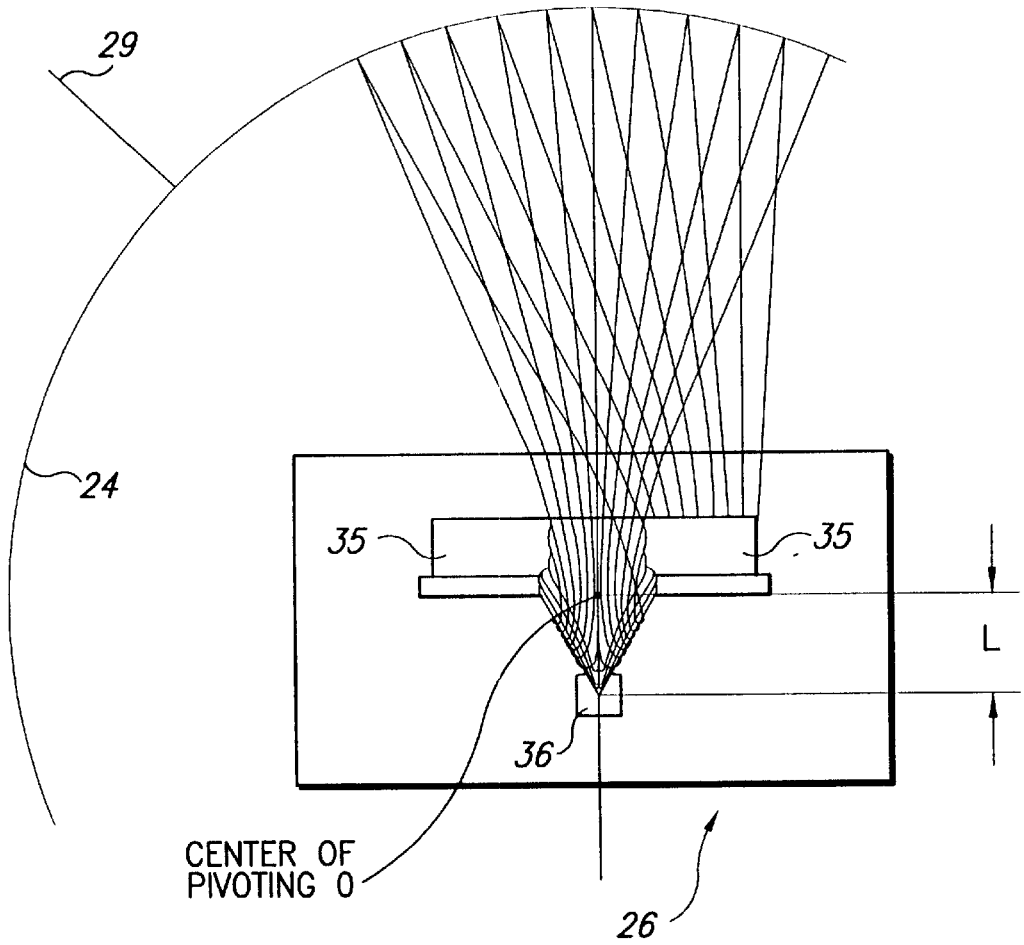
FIG. 14 is a cross-sectional view showing the light beams when the concave mirror is inclined at +45 degrees.
Figure 15:
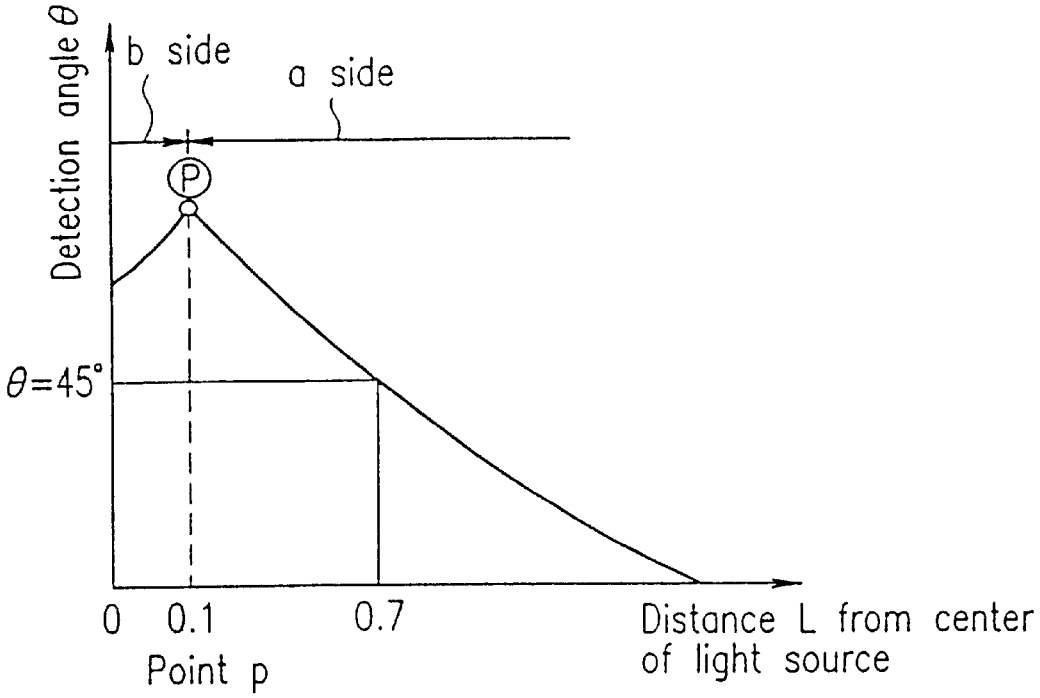
FIG. 15 is a graph showing the relationship between the detection angle θ and the distance L from the from the center of light source.

With reference to FIGS. 14 and 15, the relationship between the distance from the center of curvature to the center of pivoting O of the concave mirror 24, and the detected angle θ will be described. The curve in FIG. 15 is a qualitative curve, and point P is the point at which the light spot does not move even when the concave mirror 24 is inclined. As shown in FIG. 15, the movement of the light spot is inverted in the "a" side (direction in which the distance L increases with respect to the point P) from the "b" side (direction in which the distance L decreases with respect to the point P).

In the optical sensor used in this example in which the radius of curvature R of the concave mirror 24 is 4.7 mm, the point P is 0.1 mm away from the center of the light source (L=0.1 mm).

When the distance L is on the "a" side, the light spot moves in the opposite direction to the direction of inclination of the concave mirror 24 (FIG. 8B). When the distance L is on the "b" side, the light spot moves in the same direction as the direction of inclination of the concave mirror 24.

In this example, the distance L is on the "a" side and a detection angle within ±45 degrees is satisfactory. In such a case, from FIG. 15, the distance L is set to be 0.7 mm.

It can be appreciated from FIG. 15 that the sensing angle, i.e., the detection angle θ can be arbitrarily increased or decreased by shifting the center of curvature of the concave mirror 24 (i.e., center of the light source) with respect to the center of pivoting O. This indicates that an appropriate detection angle θ can be selected relatively easily in accordance with the device in which the optical sensor is used. Thus, the optical sensor according to the present invention is applicable to various types of input devices.

Figure 16:
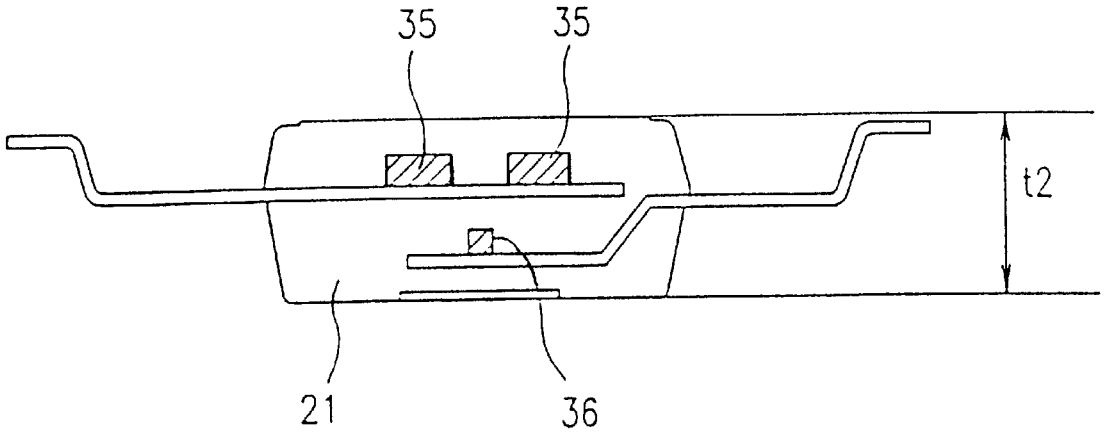
FIG. 16 is a cross-sectional view of a sensor section of the normal-type optical sensor according to the present invention showing the effect thereof.
Figure 17:
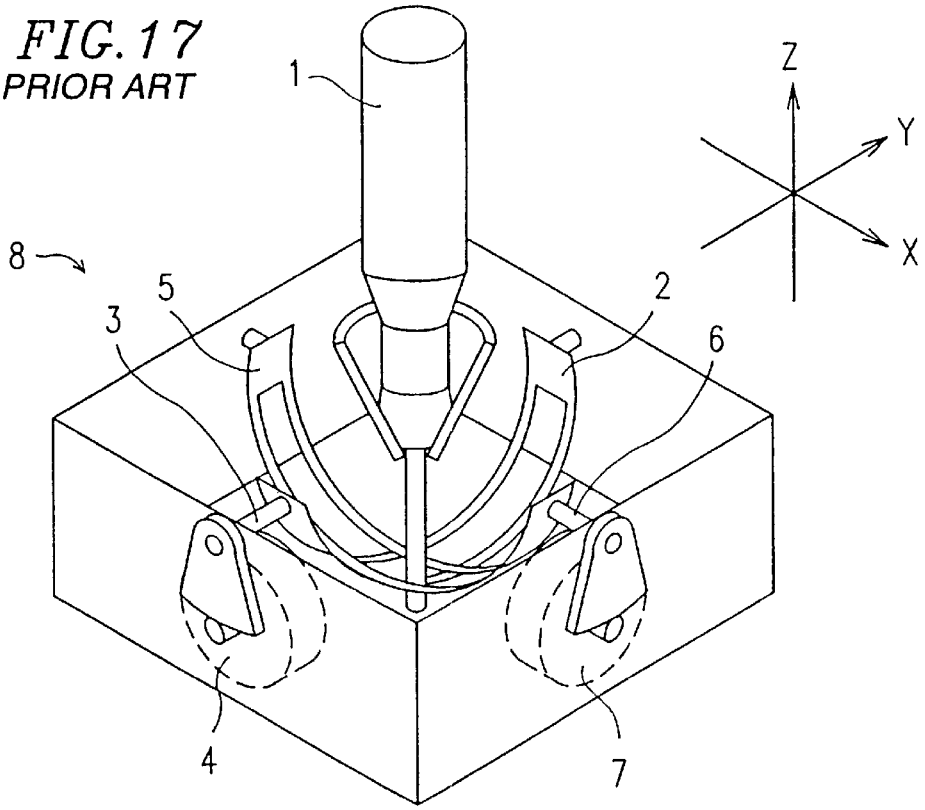
FIG. 17 PRIOR ART
FIG. 17 is an isometric view of a conventional joystick.
Figure 18A:
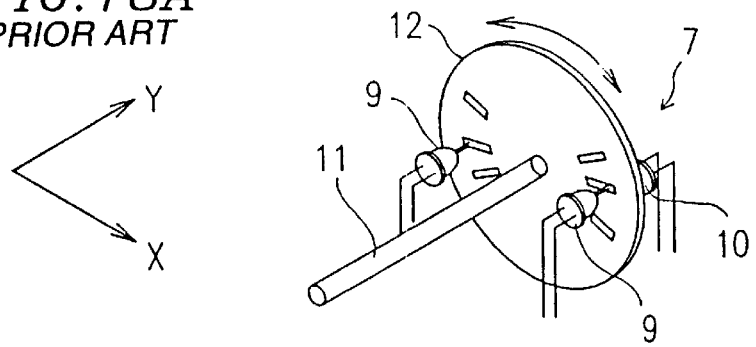
FIG. 18A PRIOR ART
FIGS. 18A and 18B are isometric views of a rotary encoder used in the conventional joystick.
Figure 18B:
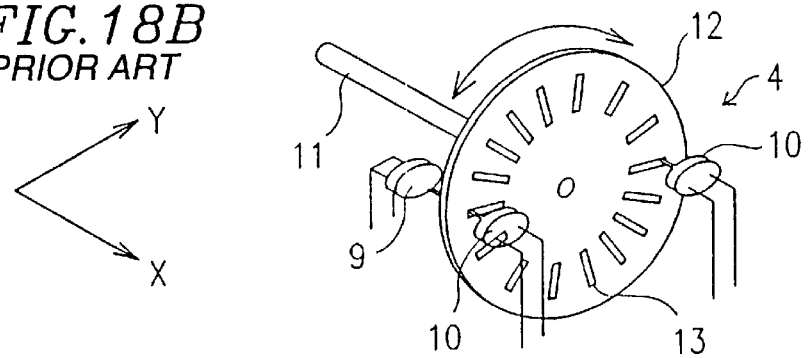
FIG. 18B PRIOR ART
Figure 19:
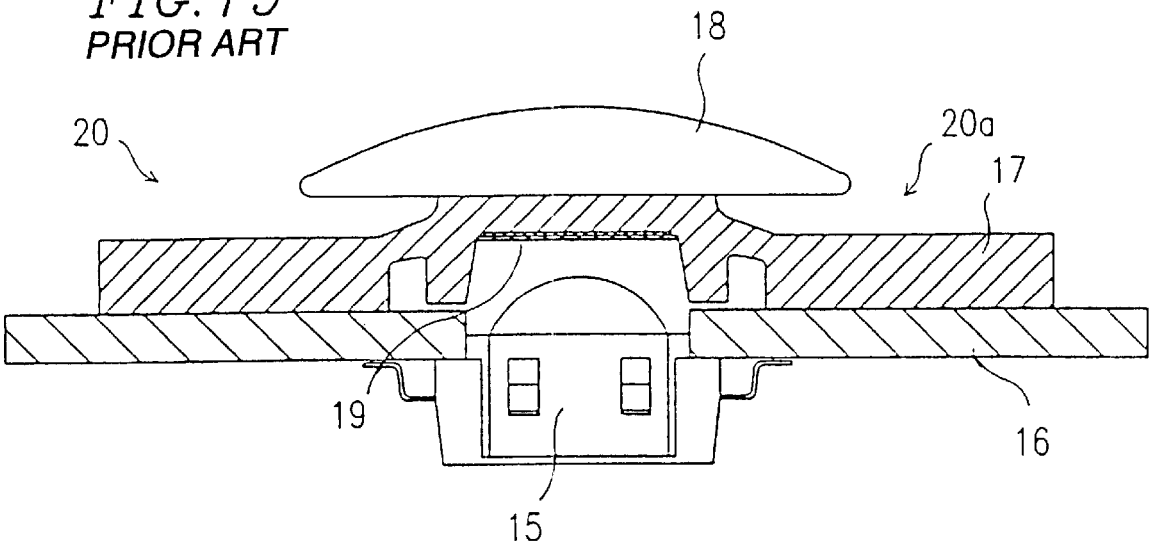
FIG. 19 PRIOR ART
FIG. 19 is a cross-sectional view of a conventional stick type using a plane mirror as a reflective body.

FIG. 16 shows the sensor section 26 of the optical sensor. In this example, the concave mirror 24 (not shown in FIG. 16) is used as the reflective body. Since the concave mirror 24 has a light collecting function unlike a plane mirror, a lens such as an objective lens can be eliminated. The thickness of the sensor section can be reduced and be closer to the concave mirror by the thickness of the lens. Thus, the total thickness of the optical sensor can be reduced. This is advantageous in reducing the size and production cost.

Figure 20:
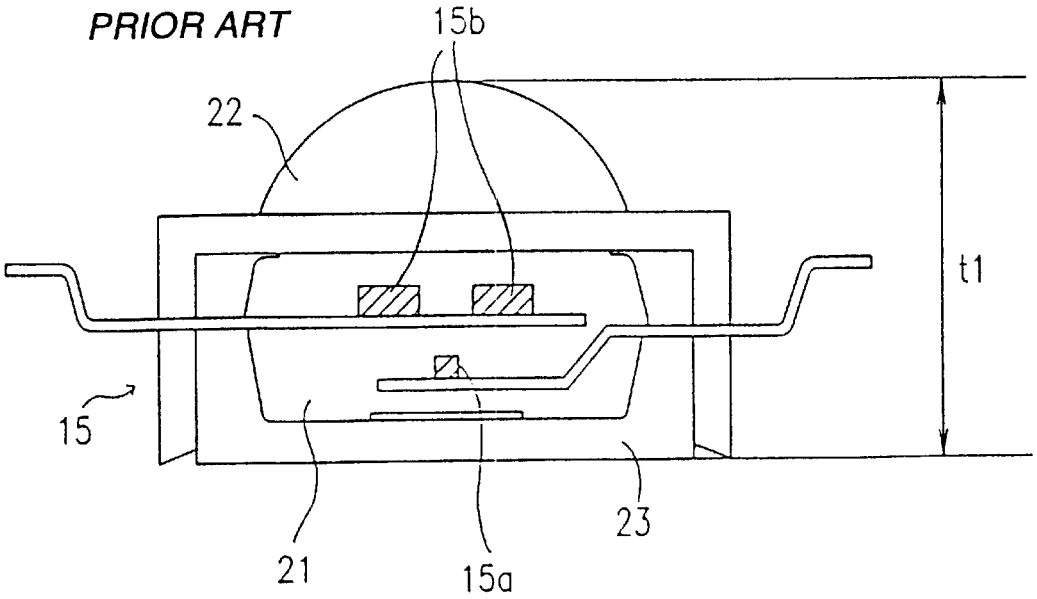
FIG. 20 PRIOR ART
FIG. 20 is a cross-sectional view of a sensor section of the conventional button type pointing device.

As can be appreciated from the comparison between the optical sensor in FIG. 16 in this example and the conventional optical sensor shown in FIG. 20, the former also does not require the secondary mold. For these reasons, the thickness of the optical sensor in this example can be reduced from t1 to t2, which realizes size reduction and lower cost.

Moreover, the optical sensor in this example can sense the light in a wide range of angles of ±45 degrees. This is a significant improvement from the range of ±10 degrees in the conventional sensors. Such a wide range of sensing angles can significantly increase the inclination angle of the stick 29.

In the above example, two photodiodes are provided both in the X and Y directions. Three or more photodiodes can be provided in each direction.

In the above example, a plurality of photodiodes are provided both in the X and Y directions to form a two-dimensional sensor section. Alternatively, a plurality of photodiodes can be provided in either direction alone. The optical sensor having such a structure can perform wide-range one-dimensional sensing.

In the above example, a plurality of spot-like photodiodes are arranged two-dimensionally with respect to the light emitting diode. Alternatively, a two-dimensional optical sensor section can be realized by providing one area sensor for sensing light in both the X and Y directions.

The structure of the optical sensor section is not limited to the combination of a light emitting diode and a photodiode.

In the above example, four supporting columns are used. One supporting column can support the concave mirror as long as the column is sufficiently strong.

The concave mirror, unlike from a plane mirror, can effectively guide the reflected light to a light receiving element. Such a feature of the concave mirror realizes wide-range sensing with a high resolution. The operation section can move through a wide range of angles. The optical sensor having such a structure is preferably usable in an input device of a game machine and other devices for which the wide-ranging movement of the operation section is desired.

In the case where the optical sensor according to the present invention is used for a pointing device of a computer, the moving distance of the pointer can be reduced compared to the moving distance of the operation section. Therefore, the pointer can be moved more precisely.

The optical sensor, which can detect light in a non-contact fashion, has improved durability. Unlike the rotary encoder, the sensor section does not require a rotatable shaft and thus can be sealed. Thus, malfunctions caused by dust can be avoided. Accordingly, high precision detection is realized for a long time, thereby improving the reliability.

In the structure where the light receiving elements are arranged two-dimensionally with respect to the light emitting element, the angle of two-dimensional inclination of the operation section, namely, the two-dimensional operation amount of light, can be detected by one sensor section. Unlike the case of using rotary encoders, one sensor is sufficient. This contributes to size reduction.

In the structure where the concave mirror is supported along the circumferential surface thereof, the concave mirror and the operation section associated with the concave mirror can be moved in an arbitrary direction relatively easily.

In the structure where the center of curvature of the concave mirror is shifted with respect to the center of pivoting, the range of sensing angles can be adjusted relatively easily as can be appreciated from the examples presented above. Such an optical sensor is widely applicable to various types of input devices in accordance with the required range of detection angles.

In the case where the concave mirror has an outer slidable surface having the center of curvature at the center of pivoting of the concave mirror and the support has an inner guide surface, the operation section can be moved smoothly so as to realize improved operability.

In the structure where the support has a stopper section and the concave mirror has a stopper member contactable with the stopper section of the support, the concave mirror and the operation section can be positioned at a prescribed angle of inclination with certainty. Accordingly, the concave mirror and the operation section are not damaged accidentally.

The structure in which the concave mirror is connected to the operation section via a supporting column standing on the concave mirror, the sensor section is supported by an arm in a secured manner, and the arm is provided at such a position that avoids interfering with the supporting column which moves integrally with the operation section and the concave mirror is advantageous in improving the angle of inclination of the operation section.

In the structure where a section including the sensor section, the concave mirror, the support, the arm, and the supporting column is sealed by a sealing device, external disturbance light is prevented from being detected by the sensor section. Thus, the detection accuracy is enhanced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An optical sensor, comprising:

a sensor section provided in a secured manner and including a light emitting element and a light receiving element; and a reflective body connected to an operation section and movable with respect to the sensor section, wherein the reflective body is a concave mirror for guiding light from the light emitting element to the light receiving element, wherein the light receiving element is located with reference to a center of curvature of an outer circumferential surface of the concave mirror, wherein the concave mirror is pivotally supported along the outer circumferential surface thereof by a support guide, and wherein a plurality of hemispheric projections are formed on an inner guide surface of the support guide to reduce a contact resistance between the inner guide surface and the outer circumferential surface of the concave mirror.

2. An optical sensor according to claim 1, wherein the concave mirror is connected to the operation section via a supporting column standing on the concave mirror, the sensor section is supported by an arm in a secured manner, and the arm is provided at a position that avoids interference between the supporting column which moves integrally with the operation section and the concave mirror.

3. An optical sensor according to claim 2, wherein a section including the sensor section, the concave mirror, the support guide, the arm, and the supporting column is sealed by a sealing device.

4. An optical sensor, comprising:

a sensor section provided in a secured manner and including a light emitting element and a plurality of light receiving elements located two-dimensionally with respect to the light emitting element; and a reflective body connected to an operation section and movable two-dimensionally with respect to the sensor section, wherein the reflective body is a concave mirror for guiding light from the light emitting element to the plurality of light receiving elements, wherein the light receiving elements are arranged symmetrically with respect to a center of curvature of an outer circumferential surface of the concave mirror, wherein the concave mirror is pivotally supported along the outer circumferential surface thereof by a support guide, and wherein a plurality of hemispheric projections are formed on an inner guide surface of the support guide to reduce a contact resistance between the inner guide surface and the outer circumferential surface of the concave mirror.

5. An optical sensor according to claim 4, wherein the outer circumferential surface of the concave mirror is slidable.

6. An optical sensor according to claim 4, wherein a center of curvature of an inner surface of the concave mirror is shifted with respect to a center of pivoting of the concave mirror.

7. An optical sensor according to claim 5, wherein the center of curvature of the outer slidable circumferential surface of the concave mirror coincides with a center of pivoting of the concave mirror.

8. An optical sensor according to claim 5, wherein the support guide has a stopper section, and the concave mirror has a stopper member contactable with the stopper section of the support guide.

9. An optical sensor, comprising:

a sensor section provided in a secured manner and including a light emitting element and a plurality of light receiving elements; and a concave mirror connected to an operation section and movable with respect to the sensor section, the concave mirror guiding light from the light emitting element to the plurality of light receiving elements, wherein the light emitting element is arranged at a center position of a radius of curvature of an inner surface of the concave mirror, wherein the plurality of light receiving elements are arranged in a plane that passes through a center of pivoting of the concave mirror, wherein the concave mirror is pivotally supported along an outer circumferential surface thereof by a support guide, and wherein a plurality of hemispheric projections are formed on an inner guide surface of the support guide to reduce a contact resistance between the inner guide surface and the outer circumferential surface of the concave mirror.

10. The optical sensor according to claim 9, wherein the outer circumferential surface of the concave mirror is slidable.

11. The optical sensor according to claim 10, further comprising:

a stopper mechanism for limiting the pivoting movement of the concave mirror.

12. An optical sensor, comprising:

a sensor section provided in a secured manner and including a light emitting element and light receiving elements; and a concave mirror connected to an operation section and movable with respect to the sensor section, the concave mirror guiding light from the light emitting element to the light receiving elements, wherein the concave mirror is pivotally supported along an outer slidable circumferential surface thereof by a support guide, and wherein a plurality of hemispheric projections are formed on an inner guide surface of the support guide to reduce a contact resistance between the inner guide surface and the outer slidable circumferential surface of the concave mirror.

13. The optical sensor according to claim 12, wherein the light emitting element is arranged at a center position of a radius of curvature of an inner surface of the concave mirror, and wherein the light receiving elements are arranged in a plane that passes through a center position of a radius of curvature of the outer slidable circumferential surface of the concave mirror.

* * * * *